United States Patent [19]

Lynch et al.

[11] Patent Number: 5,069,047

[45] Date of Patent: Dec. 3, 1991

[54] RELEASE OF PIN-CLUTCH MECHANISM IN THEFT-DETERRENT DEVICE

[75] Inventors: John L. Lynch, Holiday; Lincoln H. Charlot, Jr., St. Petersburg, both of Fla.

[73] Assignee: Security Tag Systems, Inc., St. Petersburg, Fla.

[21] Appl. No.: 608,152

[22] Filed: Nov. 2, 1990

[51] Int. Cl.[5] ..... E05B 65/00

[52] U.S. Cl. ..... 70/57.1; 70/276

[58] Field of Search ..... 70/57.1, 276, 32, 33, 70/34

[56] References Cited

U.S. PATENT DOCUMENTS

| | | | |
|---|---|---|---|
| 2,993,152 | 6/1961 | Pierce et al. | 335/301 |
| 3,858,280 | 1/1975 | Martens | 70/57.1 |
| 3,911,534 | 10/1975 | Martens | 70/57.1 |
| 4,012,813 | 3/1977 | Martens et al. | 70/57.1 |
| 4,339,853 | 7/1982 | Lipschitz | 70/57.1 |
| 4,523,356 | 6/1985 | Charlot, Jr. | 24/706.8 |
| 4,527,310 | 7/1985 | Vandebult | 70/57.1 |
| 4,603,453 | 8/1986 | Yokoyama | 70/57.1 |
| 4,651,136 | 3/1987 | Anderson et al. | 340/572 |
| 4,774,500 | 9/1988 | Bussard | 70/57.1 |
| 4,903,383 | 2/1990 | Gartshore | 340/572 |
| 4,987,754 | 1/1991 | Minasy | 70/57.1 |

*Primary Examiner*—Robert L. Wolfe

*Attorney, Agent, or Firm*—Edward W. Callan

[57] ABSTRACT

An apparatus for releasing locked components of a theft-deterrent device includes a seat for receiving a component of the theft deterrent device that contains a clutch and a ferromagnetic anvil that is positioned by a spring to force the clutch to apply pressure against an inserted pin that is anchored in another component of the device so as to restrain the pin from release from the clutch; and a magnet with a pole piece coupled thereto, with the magnet and the pole piece being disposed for movement between a protracted position and a retracted position. When magnet and the pole piece are in their protracted position the pole piece is disposed about the sides of the clutch-containing component and applies magnetic flux from the magnet that is directed to overcome the force of the spring and reposition the ferromagnetic anvil to thereby relax the pressure applied against the pin by the clutch so that the pin-anchoring component can be released from the clutch-containing component. The magnet and the pole piece are forced into their protracted position by a spring; and a flange is attached to the pole piece for enabling the magnet and the pole piece to be moved to their retracted position by applying pressure against the flange to overcome the force of the spring. When the magnet and the pole piece are in their retracted position, the attraction between the magnet and the anvil is less and the sides of the clutch-containing component are exposed so that the clutch-containing component can easily be gripped at its sides and removed from the seat. Also, when the magnet and the pole piece are in their retracted position, the releasing apparatus does not then enable the pin-anchoring component to be released from the clutch-containing component; and the releasing apparatus further includes a lock for locking the magnet and the pole piece in their retracted position to prevent unauthorized use of the releasing apparatus.

16 Claims, 2 Drawing Sheets

RELEASE OF PIN-CLUTCH MECHANISM IN THEFT-DETERRENT DEVICE

BACKGROUND OF THE INVENTION

The present invention is generally directed to releasing locked components of a pin-clutch mechanism and is particularly directed to an improvement in apparatus for magnetically releasing locked components of a theft-deterrent device of the type in which a pin-anchoring component and a clutch-containing component are adapted to be locked together on opposite sides of a portion of a protected article to prevent unauthorized removal of the device from the article.

Examples of pin-clutch mechanisms that are used in theft-deterrent devices are described in U.S. Pat. No. 4,523,356 to Lincoln H. Charlot, Jr. and U.S. patent application Ser. No. 07/529,940 filed May 29, 1990 by Lincoln H. Charlot, Jr. application Ser. No. 07/529,940 further describes an apparatus for releasing the pin-clutch mechanism described therein. The clutch mechanism described in U.S. Pat. No. 4,523,356 and application Ser. No. 07/529,940 includes a ferromagnetic anvil having an axial bore for axially receiving the pin; receiving means axially aligned with the anvil for axially receiving a said pin that is axially received by the bore of the anvil, wherein the anvil is longitudinally movable along its bore axis with respect to the receiving means; and a spring for forcing the anvil toward a first end of the receiving means; clutching means engaging the anvil and forced by the anvil toward the first end of the receiving means when the anvil is forced toward the first end of the receiving means by the spring, with the clutching means being disposed to apply radial pressure against said pin to firmly clutch the pin when the clutching means are forced toward the first end of the receiving means and thereby restrain the pin from release from the clutching means. An apparatus for releasing the pin-clutch mechanism described in U.S. Pat. No. 4,523,356 includes a magnet disposed for axially applying magnetic flux to the anvil to overcome the force of the spring and force the anvil to move away from the first end of the receiving means.

The clutch mechanism described in application Ser. No. 07/529,940 further includes a radially disposed pole piece for directing magnetic flux applied radially by means external to the mechanism so that at least a predetermined amount of said radially applied magnetic flux is so concentrated axially in the anvil as to overcome the force of the spring and force the anvil to move away from the first end of the receiving means. The pole piece of the clutch mechanism includes a ferromagnetic disc-shaped ring disposed adjacent the first end of the receiving means in a plane that is perpendicular to said axis.

The releasing apparatus described in application Ser. No. 07/529,940 includes an axially disposed magnet for providing in excess of said predetermined amount of magnetic flux; a pole piece coupled to the magnet and disposed coaxially with the magnet for applying in excess of said predetermined amount of magnetic flux radially toward the axis of the magnet in a plane that is beyond the magnet; and a seat for receiving the clutch mechanism in a position in which the pole piece of the clutch mechanism is so disposed in relation to the pole piece of the releasing apparatus as to direct magnetic flux applied radially by the pole piece of the releasing apparatus and to concentrate at least said predetermined amount of said radially applied magnetic flux in the anvil to thereby overcome the force of the spring and force the anvil to move away from the first end of the receiving means to thereby relax the radial pressure applied against the pin by the clutching means so that the pin-anchoring component can be released from the clutch-containing component. The pole piece of the releasing apparatus terminates in a rim that is adjacent the ferromagnetic disc-shaped ring of the clutch mechanism when said clutch-containing component is received by the seat.

The attactive force applied to the clutch-containing component by the magnet of the releasing apparatus makes it difficult to remove the clutch-containing component from the seat of the releasing apparatus following release and removal of the pin-anchoring component. Such difficulty is compounded when using the releasing apparatus described in application Ser. No. 07/529,940 because the pole piece of the releasing apparatus is positioned about the sides of the clutch-containing component, whereby it is difficult to grip the clutch-containing component to remove the clutch-containing component from the seat of the releasing apparatus following release and removal of the pin-anchoring component.

SUMMARY OF THE INVENTION

The present invention provides a releasing apparatus from which the clutch-containing component may easily be removed following release and removal of the pin-anchoring component.

In one aspect of the present invention, the releasing apparatus includes a seat for receiving a component of a device that contains a clutch and a ferromagnetic anvil that is positioned to force the clutch to apply pressure against an inserted pin that is anchored in another component of the device so as to restrain the pin from release from the clutch; a magnet disposed for movement between a protracted position and a retracted position such that when the clutch-containing component is received by the seat and the magnet is in its protracted position, the magnet applies magnetic flux that attracts and thereby repositions the ferromagnetic anvil to thereby relax the pressure applied against the pin by the clutch so that the pin-anchoring component can be released from the clutch-containing component; and means for moving the magnet to its retracted position, in which the magnet is disposed a greater distance from said seated clutch-containing component than when in its protracted position, whereby when the magnet is in its retracted position, the attraction between the magnet and the ferromagnetic anvil is such that the clutch-containing component can easily be removed from the seat.

In another aspect of the present invention, the releasing apparatus includes a seat for receiving a component of a theft deterrent device that contains a clutch and a ferromagnetic anvil that is positioned to force the clutch to apply pressure against an inserted pin that is anchored in another component of the device so as to restrain the pin from release from the clutch; a magnet with a pole piece coupled thereto, with the pole piece being disposed for movement between a protracted position and a retracted position such that when the clutch-containing component is received by the seat and the pole piece is in its protracted position, the pole piece is disposed about the sides of the clutch-containing component and applies magnetic flux from the magnet that is directed to reposition the ferromagnetic anvil to thereby relax the pressure applied against the pin by the clutch so that the pin-anchoring component can be released from the clutch-containing component; and means for moving the pole piece to its retracted position, in which the sides of the clutch-containing component are exposed so that the clutch-containing component can easily be gripped at its sides for removal from the seat.

In a preferred embodiment of both aspects of the invention, when the magnet and/or pole piece is in its retracted position, the applied magnetic flux does not overcome the force of the spring and reposition the anvil, such that the releasing apparatus does not then enable the pin-anchoring component to be released from the clutch-containing component; and the releasing apparatus further includes a lock for locking the magnet and/or pole piece in its retracted position to prevent unauthorized use of the releasing apparatus.

Additional features of the present invention are described in relation to the description of the preferred embodiment.

DESCRIPTION OF THE PREFERRED EMBODIMENT

Figure 1:
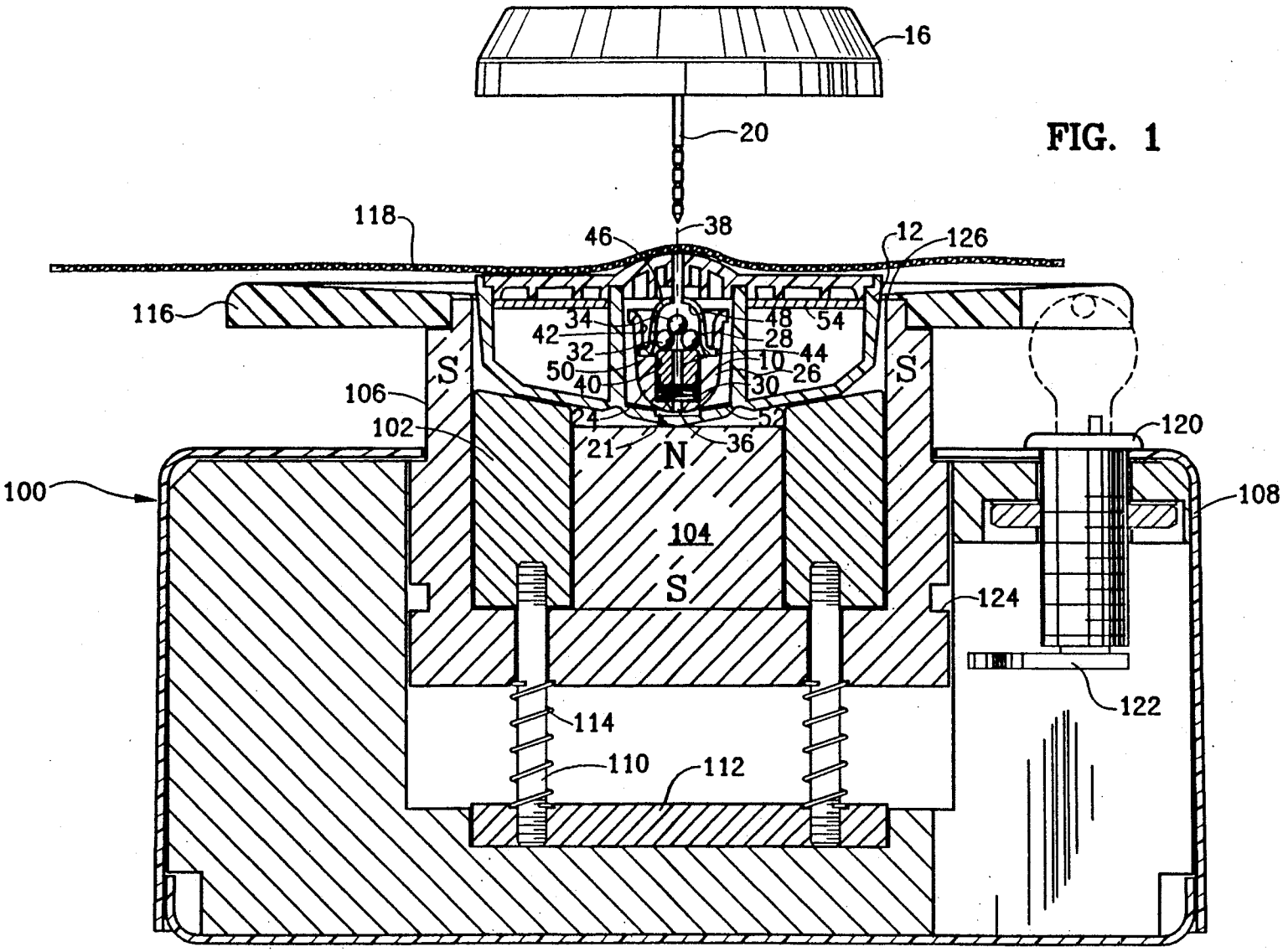
FIG. 1 is a sectional view of a preferred embodiment of the releasing apparatus of the present invention, illustrating the magnet and the pole piece of the releasing apparatus in their protracted position, a clutch-containing component on the seat of the apparatus, and a pin-anchoring component being removed from the clutch-containing component.
Figure 2:
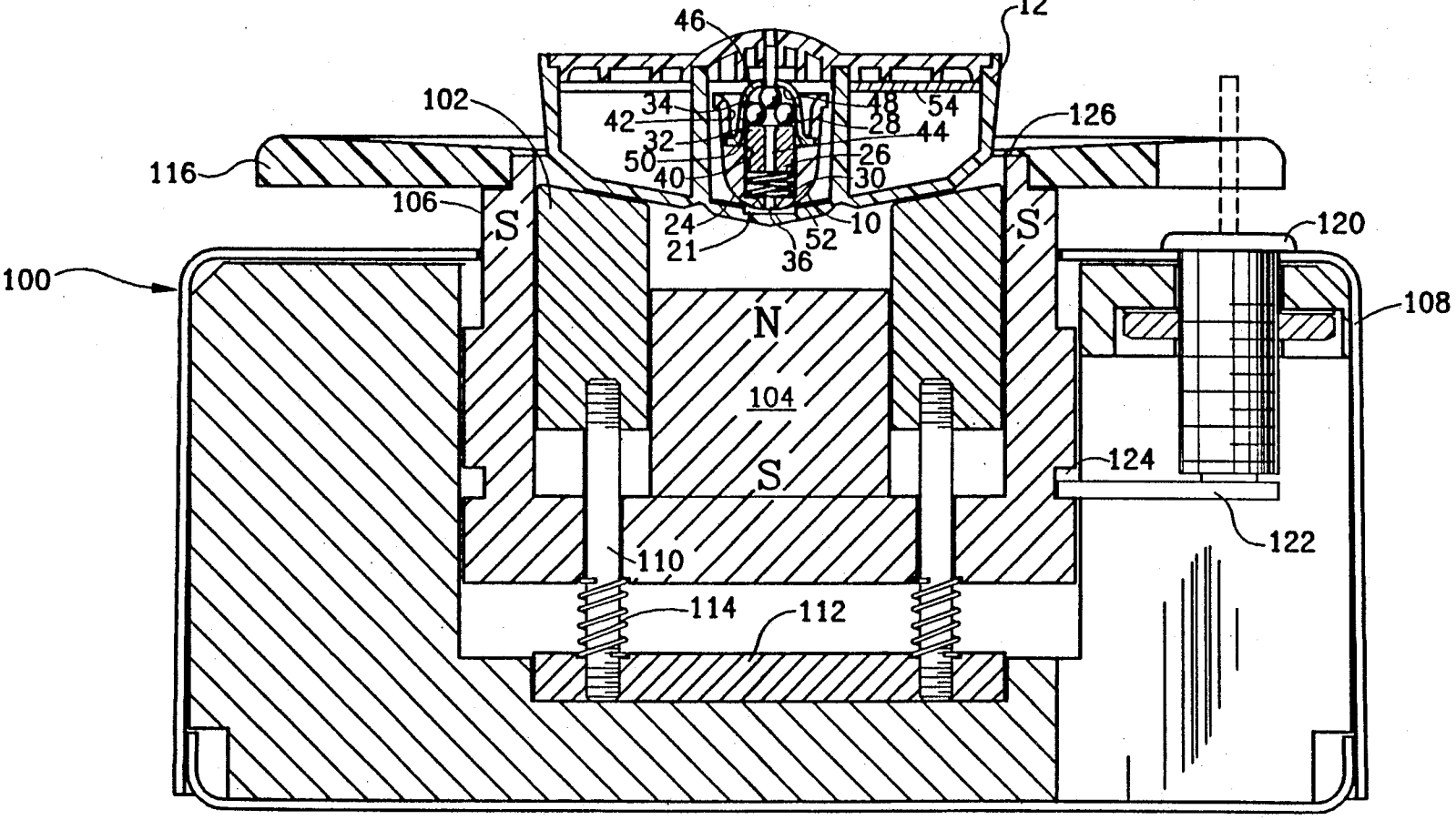
FIG. 2 is a sectional view of the releasing apparatus shown in FIG. 1, illustrating the magnet and the pole piece of the releasing apparatus in their retracted position, and the clutch-containing component being exposed for easy removal from the seat of the apparatus.

Referring to the Drawing, a preferred embodiment of the releasing apparatus 100 of the present invention includes a seat 102, a magnet 104 and a pole piece 106 contained within a housing 108. The magnet 104 is a solid cylinder; and the seat 102 is a hollow cylinder that is coaxial with the magnet 104. The seat 102 is supported in a fixed position on a set of posts 110 secured to a base 112 in the floor of the housing 108. The magnet 104 contacts and is supported by the pole piece 106, which is supported on a set of springs 114 disposed about the supporting posts 100. The springs 114 force the magnet 104 and the pole piece 106 into a protracted position, as shown in FIG. 1. A flange 116 on the pole piece 106 enables the magnet 104 and the pole piece 106 to be moved to a retracted position, as shown in FIG. 2, by applying pressure against the flange 116 to overcome the force of the springs 114.

The releasing apparatus 100 further includes a locking mechanism that includes a key-operated lock 120 disposed through the housing 108, and a locking arm 122 that is movable by operation of the lock 120 to engage a slot 124 in the pole piece 106, and thereby lock the magnet 104 and the pole piece 106 in their retracted position.

In an example of operation of the releasing apparatus 100, a theft deterrent device attached to a protected article 118, such as a garment, and including a clutch-containing component 12 and a pin-anchoring component 16 is received on the seat 102. The theft deterrent device may be of the type in which the pin-anchoring component 16 contains a detrimental substance, such as permanent ink, in fragile vials that are fractured to release the detrimental substance if one attempts to pry these two components apart, as described in U.S. Pat. No. 4,994,075 to Dennis L. Hogan. Alternatively, or additionally, the theft deterrent device may contain an electronic-article-surveillance system transponder that causes an alarm to be produced if an article to which the theft-deterrent device is attached is removed from monitored premises without the device first being removed from the article. Such transponders are described in U.S. Pat. Nos. 4,481,428 to Lincoln H. Charlot, Jr.; 4,654,641 to Lucian G. Ferguson and Lincoln H. Charlot, Jr.; 4,670,740 to Fred Wade Herman and Lincoln H. Charlot, Jr. and 4,727,360 to Lucian G. Ferguson and Lincoln H. Charlot, Jr.

The clutch-containing component 12 contains a ball-clutch mechanism as described in the aforementioned U.S. Pat. No. 4,523,356. The clutch mechanism 10 includes a housing 24 that contains a ferromagnetic anvil 26, a cup 28, a spring 30, a first set of two balls 32 and a second set of two balls 34. All of the balls 32, 34 are uniformly dimensioned.

The interior of the housing 24 is symmetrical. The housing 24 has a substantially confining end 21 and includes a small axial bore 36 in the confining end 21 for admitting the pin 20 longitudinally along the axis 38 of the bore 36.

Communicating with the small bore 36 is a larger axial bore 40 along the axis 38. The larger axial bore 40 contains the spring 30, which is disposed to exert force longitudinally along the common axis 38. One end of the spring 30 is supported by the confining end 21 of the housing 24 and the other end of the spring 30 engages a spring guide at the periphery of the anvil 26.

The anvil 26 is made of a magnetic material which can be attracted by an electromagnet so as to draw the anvil 26 against the force of the spring 30 toward the confining end 21 of the housing 24. The anvil 26 is generally cylindrical and is dimensioned radially to closely fit within the larger bore 40 of the housing 24.

The housing 24 has a still larger axial bore 42 communicating with the large bore 40 along the common axis 38. The still larger bore 42 contains the cup 28.

The anvil 26 has an axial bore 44 for axially receiving the pin 20 along the common axis 38.

The cup 28 is radially symmetrical. The cup 28 has a confining end 46, a tapered interior wall 48 and a predominantly open end 50 covering the anvil 26. The cup 28 has a small axial opening in its confining end 46 and is axially aligned with the anvil along the common axis 38 for axially receiving the pin 20. The cup 28 is made of nickel-plated die-cast steel.

The anvil 26 is longitudinally movable along the common axis 38 with respect to the cup 28. The spring 30 is positioned for forcing the anvil 26 toward the confining end 46 of the cup 28.

The first set of balls 32 engage the anvil 26 and are forced by the anvil 26 toward the confining end 46 of the cup by the spring 30.

The second set of balls 34 is positioned in the extreme confining end 46 of the cup 28 for clutching the pin 20. The interior wall 48 of the cup 28 is dimensioned and tapered with respect to the balls 32, 34 to cause the balls 32 of the first set to be in a different radial plane from the balls 34 of the second set and to cause the balls 34 of the second set to contact the pin 20. When the balls 32 of the first set are forced toward the confining end 46 of the cup 28 by the force of the spring 30 on the anvil 26, the balls 32 of the first set wedge the balls 34 of the second set between the tapered interior wall 48 of the cup 28 and the pin 20 and uniformly space the balls 34 of the second set to apply symmetrical radial pressure against the pin 20 to firmly clutch the pin 20 and thereby restrain the pin 20 from longitudinal movement. All of the balls 32, 34 are stainless steel ball bearings.

The surface of the anvil 26 that engages the first set of balls 32 is shaped to have a uniform outward concave contour in order to prevent the balls 32 of the first set from touching the pin 20 when the anvil 26 is forced toward the confining end 46 of the cup 28. The contour of the concave surface has the same radius as the balls 32 of the first set.

The pin 20 has a point and a head for enabling the ball clutch mechanism to be attached to an article 118, such as a garment, by inserting the pointed end of the pin 20 through the article, through the small opening in the cup 28 and into the bore 44 of the anvil 26. The pin 20 includes circumferential notches for engaging the second set of balls 34 when the pin 20 is inserted into the anvil bore 44. The notches provide the user of the ball clutch mechanism with a sense of pin insertion depth and enhance the clutch of the second set of balls 34 on the pin 20. The pin 20 is made of stainless steel.

The clutch mechanism 10 further includes a ferromagnetic shield 52 that is disposed axially in relation to the anvil 26 for diffusing magnetic flux applied axially to the anvil by means external to the clutch mechanism 10 so as to prevent less than a predetermined amount of said axially applied magnetic flux from overcoming the force applied by the spring 30 and forcing the anvil 26 to move away from the confining end 46 of the cup 28. The shield 52 is positioned at the opposite end of the clutch mechanism 10 from the confining end 46 of the cup 28.

The clutch mechanism 10 is so constructed that magnetic flux must be applied radially to the clutch mechanism 10 in order to force the anvil 26 to overcome the force applied by the spring 30 and move away from the confining end 46 of the cup 28 to release the pin 20 from the grasp of the first set of balls 32 so that the clutch-containing component 12 can be separated from the pin-anchoring component 16. To axially concentrate radially applied flux in the anvil 26 in order to overcome the force of the spring 30 and force the anvil 26 to move away from the confining end 46 of the cup 28, the clutch mechanism 10 includes a ferromagnetic pole piece 54 that is radially disposed for directing magnetic flux applied radially by means external to the clutch mechanism 10 so that at least a predetermined amount of said radially applied magnetic flux is so concentrated axially in the anvil 26. In this embodiment, the pole piece 54 is a ferromagnetic disc-shaped ring that is disposed adjacent the confining end of the cup 28 in a plane that is perpendicular to the bore axis 38.

Magnetic flux is radially applied to the clutch mechanism 10 of the clutch-containing component 12 theft deterrent device when the clutch-containing component 12 is positioned in the releasing apparatus 100 and the magnet 104 and the pole piece 106 are in their protracted position, as shown in FIG. 1.

The magnet 104 provides in excess of said predetermined amount of magnetic flux, and has a North-South magnetic axis that is aligned with the bore axis 38 of the clutch mechanism 10 when the clutch-containing component 12 is positioned within the releasing apparatus 100 as shown in FIG. 1. One pole of the magnet 104 contacts the pole piece 106.

The pole piece 106 is disposed coaxially with the magnet 104 and includes a coaxial shell having a horizontal base and a generally vertical wall that terminates in a rim 126 from which magnetic flux in excess of said predetermined amount of magnetic flux is applied radially toward the axis of the magnet 104. The radially applied flux from the rim 126 of the pole piece 106 initially flows toward the axis of the magnet 104 in a plane that is beyond the magnet 104 and aligned with the radially disposed pole piece 54 of the clutch mechanism 10 when the clutch-containing component 12 is received on the seat 102 of the releasing apparatus 100 and the pole piece 106 is in its protracted position, as shown in FIG. 1.

The shape of the pole piece 54 of the clutch mechanism 10 is that of a disc-shaped ring so that the pole piece extends close to the rim 126 of the pole piece 106 when the pole piece 106 is in its protracted position, as shown in FIG. 1.

When the clutch-containing component 12 is received on the seat 102 of the releasing apparatus 100 and the magnet 104 and the pole piece 106 are in their protracted position, as shown in FIG. 1, the pole piece 54 of the clutch mechanism 10 is so disposed in relation to the pole piece 106 of the releasing apparatus 100 as to direct the magnetic flux that is applied radially by the pole piece 106 and to concentrate at least said predetermined amount of said radially applied magnetic flux in the anvil 26 to thereby overcome the force applied by the spring 30 and force the anvil 26 to move away from the confining end 46 of the cup 28, and thereby relax the pressure applied against the pin 20 by the clutch mechanism 10 so that the pin-anchoring component 16 can be released and removed from the clutch-containing component 12, as shown in FIG. 1. Such removal of the pin-anchoring component 16 effects removal of the article 118 from the theft deterrent device.

After the pin-anchoring component 16 and the article 118 are removed from the clutch-containing component 12, pressure is then applied against the top of the flange 116 to move the magnet 104 and the pole piece 106 to their retracted position, as shown in FIG. 2, in which the attraction between the magnet 104 and the ferromagnetic anvil 26 is such that the clutch-containing component 12 can easily be removed from the seat 102, and the sides of the clutch-containing component 12 are exposed so that the clutch-containing component 12 can easily be gripped at its sides for removal from the seat 102.

When the magnet 104 and the pole piece 106 are in their retracted position, the magnetic flux applied by the magnet 104 does not to overcome the force of the spring 30 of the clutch mechanism 10 of the seated clutch-containing component 12, and the magnetic flux applied by the pole piece 106 is not directed to overcome the force of the spring 30 and reposition the anvil 26 in the clutch mechanism 10, such that the releasing apparatus 100 does not then enable the pin-anchoring component 16 to be released from the clutch-containing component 12. Accordingly operation of the locking mechanism 120, 122, 124 to lock the magnet 104 and the pole piece 106 in their retracted position prevents unauthorized use of the releasing apparatus 100.

We claim:

1. An apparatus for releasing locked components of a device of the type that includes means for attaching the device to an article, with said attaching means being embodied in two components that are adapted to be locked together on opposite sides of a portion of said article to prevent unauthorized removal of the device from the article, wherein the attaching means include a pin anchored within one component and a clutch mechanism contained in the other component, the releasing apparatus comprising a seat for receiving a component of a device that contains a clutch and a ferromagnetic anvil that is positioned to force the clutch to apply pressure against an inserted pin that is anchored in another component of the device so as to restrain the pin from release from the clutch;

a magnet disposed for movement between a protracted position and a retracted position such that when the clutch-containing component is received by the seat and the magnet is in its protracted position, the magnet applies magnetic flux that attracts and thereby repositions the ferromagnetic anvil to thereby relax the pressure applied against the pin by the clutch so that the pin-anchoring component can be released from the clutch-containing component; and means for moving the magnet to its retracted position, in which the magnet is disposed a greater distance from said seated clutch-containing component than when in its protracted position, whereby when the magnet is in its retracted position, the attraction between the magnet and the ferromagnetic anvil is such that the clutch-containing component can easily be removed from the seat.

2. An apparatus according to claim 1, comprising a spring for forcing the magnet into its protracted position;

wherein the means for moving the magnet includes a flange coupled to the magnet for enabling the magnet to be moved to its retracted position by applying pressure against said flange to overcome said force of the spring of the releasing apparatus.

3. An apparatus according to claim 1, wherein the magnetic flux applied by the magnet when the magnet is in its retracted position does not overcome the force of the spring of the clutch mechanism of said seated clutch-containing component, such that the releasing apparatus does not then enable the pin-anchoring component to be released from the clutch-containing component; and wherein the apparatus further comprises means for locking the magnet in its retracted position.

4. An apparatus for releasing locked components of a device of the type that includes means for attaching the device to an article, with said attaching means being embodied in two components that are adapted to be locked together on opposite sides of a portion of said article to prevent unauthorized removal of the device from the article, wherein the attaching means include a pin anchored within one component and a clutch mechanism contained in the other component, the releasing apparatus comprising a seat for receiving a component of a device that contains a clutch and a ferromagnetic anvil that is positioned to force the clutch to apply pressure against an inserted pin that is anchored in another component of the device so as to restrain the pin from release from the clutch;

a magnet with a pole piece coupled thereto, with the pole piece being disposed for movement between a protracted position and a retracted position such that when the clutch-containing component is received by the seat and the pole piece is in its protracted position, the pole piece is disposed about the sides of the clutch-containing component and applies magnetic flux from the magnet that is directed to reposition the ferromagnetic anvil to thereby relax the pressure applied against the pin by the clutch so that the pin-anchoring component can be released from the clutch-containing component; and means for moving the pole piece to its retracted position, in which the sides of the clutch-containing component are exposed so that the clutch-containing component can easily be gripped at its sides for removal from the seat.

5. An apparatus according to claim 4, comprising a spring for forcing the pole piece into its protracted position;

wherein the means for moving the pole piece includes a flange on the pole piece for enabling the pole piece to be moved to its retracted position by applying pressure against said flange to overcome said force of the spring of the releasing apparatus.

6. An apparatus according to claim 4, wherein the magnetic flux applied by the pole piece when the pole piece is in its retracted position is not directed to overcome the force of the spring of the clutch mechanism of said seated clutch-containing component, such that the releasing apparatus does not then enable the pin-anchoring component to be released from the clutch-containing component; and wherein the apparatus further comprises means for locking the pole piece in its retracted position.

7. An apparatus for releasing locked components of a device of the type that includes means for attaching the device to an article, with said attaching means being embodied in two components that are adapted to be locked together on opposite sides of a portion of said article to prevent unauthorized removal of the device from the article, wherein the attaching means include a pin anchored within one component and a clutch mechanism contained in the other component, the releasing apparatus comprising a seat for receiving a component of a device that contains a clutch and a ferromagnetic anvil that is positioned to force the clutch to apply pressure against an inserted pin that is anchored in another component of the device so as to restrain the pin from release from the clutch;

a magnet with a pole piece coupled thereto, with the magnet and the pole piece being disposed for movement between a protracted position and a retracted position such that when the clutch-containing component is received by the seat and the magnet and the pole piece are in their protracted position, the pole piece is disposed about the sides of the clutch-containing component and applies magnetic flux from the magnet that is directed by the pole piece such that the magnet attracts and thereby repositions the ferromagnetic anvil to thereby relax the pressure applied against the pin by the clutch so that the pin-anchoring component can be released from the clutch-containing component; and means for moving the magnet and the pole piece to their retracted position, in which the magnet is disposed a greater distance from said seated clutch-containing component than when in its protracted position, whereby when the magnet is in its retracted position the attraction between the magnet and the ferromagnetic anvil is such that the clutch-containing component can easily be removed from the seat, and in which retracted position the sides of the clutch-containing component are exposed so that the clutch-containing component can easily be gripped at its sides for removal from the seat.

8. An apparatus according to claim 7, comprising a spring for forcing the magnet and pole piece into their protracted position;

wherein the means for moving the magnet and the pole piece includes a flange on the pole piece for enabling the magnet and the pole piece to be moved to their retracted position by applying pressure against said flange to overcome said force of the spring of the releasing apparatus.

9. An apparatus according to claim 7, wherein the magnetic flux applied by the magnet when the magnet and the pole piece are in their retracted position does not overcome the force of the spring of the clutch mechanism of said seated clutch-containing component, such that the releasing apparatus does not then enable the pin-anchoring component to be released from the clutch-containing component; and wherein the apparatus further comprises means for locking the magnet and the pole piece in their retracted position.

10. An apparatus for releasing locked components of a device of the type that includes means for attaching the device to the article, with said attaching means being embodied in two components that are adapted to be locked together on opposite sides of a portion of said article to prevent unauthorized removal of the device from the article, wherein the attaching means include a pin anchored within one component and a clutch mechanism contained in the other component, wherein the clutch mechanism includes a ferromagnetic anvil having an axial bore for axially receiving said pin; receiving means axially aligned with the anvil for axially receiving said pin that is axially received by the bore of the anvil, wherein the anvil is longitudinally movable along its bore axis with respect to the receiving means; a spring for forcing the anvil toward a first end of the receiving means; and clutching means engaging the anvil and forced by the anvil toward the first end of the receiving means when the anvil is forced toward the first end of the receiving means by the spring, with the clutching means being disposed to apply radial pressure against said pin to firmly clutch the pin and thereby restrain said pin from release from the clutch when the clutching means are forced toward the first end of the receiving means, the releasing apparatus comprising a seat for receiving the clutch-containing component;

a magnet with a pole piece coupled thereto, the pole piece being disposed for movement between a protracted position and a retracted position such that when the clutch-containing component is received by the seat and the pole piece is in its protracted position the pole piece is disposed about the sides of the clutch-containing component and applies magnetic flux from the magnet that overcomes the force of the spring of the clutch mechanism and forces the anvil away from the first end of the receiving means to thereby relax the radial pressure applied against the pin by the clutching means so that the pin-anchoring component can be released from the clutch-containing component; and means for moving the pole piece from its protracted position to its retracted position, in which the sides of the clutch-containing component are exposed so that the clutch-containing component can easily be gripped at its sides for removal from the seat.

11. An apparatus according to claim 10, comprising a spring for forcing the pole piece into its protracted position;

wherein the means for moving the pole piece includes a flange on the pole piece for enabling the pole piece to be moved to its retracted position by applying pressure against said flange to overcome said force of the spring of releasing apparatus.

12. An apparatus according to claim 10, wherein the magnetic flux applied by the pole piece when the pole piece is in its retracted position is not directed to overcome the force of the spring of the clutch mechanism of said seated clutch-containing component, such that the releasing apparatus does not then enable the pin-anchoring component to be released from the clutch-containing component; and wherein the apparatus further comprises means for locking the pole piece in its retracted position.

13. An apparatus for releasing locked components of a device of the type that includes means for attaching the device to the article, with said attaching means being embodied in two components that are adapted to be locked together on opposite sides of a portion of said article to prevent unauthorized removal of the device from the article, wherein the attaching means include a clutch mechanism contained by one said component, including a ferromagnetic anvil having an axial bore for axially receiving a pin anchored in the other said component; receiving means axially aligned with the anvil for axially receiving a said pin that is axially received by the bore of the anvil, wherein the anvil is longitudinally movable along its bore axis with respect to the receiving means; a spring for forcing the anvil toward a first end of the receiving means; clutching means engaging the anvil and forced by the anvil toward the first end of the receiving means when the anvil is forced toward the first end of the receiving means by the spring, with the clutching means being disposed to apply radial pressure against said pin to firmly clutch the pin and thereby restrain said pin from release from the clutch when the clutching means are forced toward the first end of the receiving mean; and a radially disposed first pole piece for directing magnetic flux applied radially by means external to the mechanism so that at least a predetermined amount of said radially applied magnetic flux is so concentrated axially in the anvil as to overcome the force of the spring and force the anvil to move away from the first end of the receiving means, the releasing apparatus comprising a seat for receiving the clutch-containing component;

a magnet for providing in excess of said predetermined amount of magnetic flux, with said magnet being disposed axially in relation to the anvil of said clutch-containing component received by the seat;

a second pole piece coupled to the magnet and disposed coaxially with the magnet for applying in excess of said predetermined amount of magnetic flux from the magnet radially toward the axis of the magnet in a plane that is beyond the magnet;

wherein the second pole piece is movable axially between a retracted position and a protracted position in which the second pole piece is so disposed in relation to the first pole piece of the received clutch-containing component that the first pole piece directs the magnetic flux that is applied radially by the second pole piece to concentrate at least said predetermined amount of said radially applied magnetic flux in the anvil to thereby overcome the force of the spring and force the anvil to move away from the first end of the receiving means to thereby relax the radial pressure applied against the pin by the clutching means so that the pin-anchoring component can be released from the clutch-containing component; and means for moving the second pole piece from its protracted position to its retracted position, in which the sides of the clutch-containing component are exposed so that the clutch-containing component can easily be gripped at its sides for removal from the seat.

14. An apparatus according to claim 13, comprising a spring for forcing the pole piece into its protracted position;

wherein the means for moving the second pole piece includes a flange on the second pole piece for enabling the second pole piece to be moved to its retracted position by applying pressure against said flange to overcome said force of the spring of the releasing apparatus.

15. An apparatus according to claim 13, wherein the magnetic flux applied by the second pole piece when the second pole piece is in its retracted position is not directed to overcome the force of the spring of the clutch mechanism of said seated clutch-containing component, such that the releasing apparatus does not then enable the pin-anchoring component to be released from the clutch-containing component; and wherein the apparatus further comprises means for locking the second pole piece in its retracted position.

16. An apparatus according to claim 13 for releasing a said clutch-containing component in which the first pole piece includes a ferromagnetic disc-shaped ring disposed adjacent the first end of the receiving means in a plane that is perpendicular to said axis, wherein the second pole piece terminates in a rim that is adjacent the ferromagnetic disc-shaped ring of the clutch mechanism when said clutch-containing component is received by the seat.

* * * * *